United States Patent [19]

Petterson

[11] 4,047,253

[45] Sept. 13, 1977

[54] DEVICE AND METHOD FOR UNCLOGGING DRAINS

[76] Inventor: Tor H. Petterson, 31248 Palos Verdes Drive West, Palos Verdes Peninsula, Calif. 90274

[21] Appl. No.: 636,110

[22] Filed: Nov. 28, 1975

[51] Int. Cl.[2] ..... E03D 11/00

[52] U.S. Cl. ..... 4/255; 222/3; 222/5; 222/402.13

[58] Field of Search ..... 4/255–257; 222/3, 5, 402.13; 15/406; 134/166

[56] References Cited

U.S. PATENT DOCUMENTS

| | | | |
|---|---|---|---|
| 3,525,426 | 8/1970 | Miller | 4/255 X |
| 3,789,861 | 2/1974 | Conn | 15/406 X |
| 3,823,427 | 7/1974 | Pittet | 4/255 |
| 3,952,341 | 4/1976 | Cain | 4/255 |

*Primary Examiner*—Henry K. Artis

[57] ABSTRACT

A manually operable device is placed over the drain opening so as to seal this opening. Contained within the device and in fluid communication with the drain is a cartridge which contains one or more materials which react with each other when mixed or with water in the drain to cause the emission of a blast of gas. The materials may comprise a solid and a liquid, the liquid being contained within a capsule, the device including a hand operated trigger pin which is used to pierce the capsule to effect the mixture and resultant reaction, or may comprise a single material contained within a capsule which is mixed with water above the drain when the capsule is either pierced by the trigger pin or dissolved by the water. In this manner, gas pressure is provided to clear the drain by virtue of the reaction produced when certain of the materials are mixed.

14 Claims, 5 Drawing Figures

DEVICE AND METHOD FOR UNCLOGGING DRAINS

This invention relates to a device and method for unclogging drains, and more particularly to such a device and method wherein gas pressure is provided to the drain by virtue of gas generated from the reaction resulting from the mixture of materials.

Various techniques and devices have been developed for unclogging blocked drains. One technique that has been used for many years involves the utilization of a lye or acid formulation which is poured into the drain. The use of such materials not only imposes a safety hazard to the user, but also can cause damage to the plumbing. Devices utilizing compressed gas which is released into the drain have been developed which obviate the aforementioned shortcomings of lye and acid formulations. These devices generally utilize compressed carbon dioxide or air contained within containers which are pierced to release the gas into the drain. While often highly effective in performing the desired function, these devices have the disadvantage of being rather expensive. Further, such devices are generally not reusable, or if reusable, only for a limited number of times.

The device and technique of the present invention obviates the aforementioned shortcomings of the prior art in that it utilizes relatively inexpensive replaceable cartridges which are triggered in an inexpensive operating device which can be used over and over again. This greatly cuts down the cost to the user and at the same time affords the highly effective and safe operation of gas pressure devices.

It is therefore an object of this invention to provide a highly effective gas pressure device and technique for unclogging drains which is more economical than prior art devices.

It is a further object of this invention to provide a device and technique for unclogging drains utilizing replaceable cartridges for generating gas pressure.

Other objects of the invention will become apparent as the description proceeds in connection with the accompanying drawings, of which:

Briefly described, the device and technique of the invention are as follows: Means are provided to seal the opening of the drain to be cleared. Retained by this sealing device is a cartridge containing one or more materials which can be mixed with each other or with water above the drain opening to cause a reaction whereby gas is generated. Fluid communication is provided between the cartridge and the drain so that the gas will flow unimpeded through the drain opening. Where the mixture of two (or more) materials in the cartridge are relied upon to generate the gas, one of these materials is contained within a sealed capsule. A trigger pin device is provided which may be manually operated, to puncture the capsule so as to effect the mixture of the material. Where material contained within a capsule is to be mixed with the water above the drain to effect the gas generation, this material may be released from the capsule into the water either by the aforementioned trigger pin piercing of the capsule, or by utilizing a capsule fabricated of a material which dissolves in water, relying on such dissolution to release the material contained in the capsule into the water.

Figure 1:
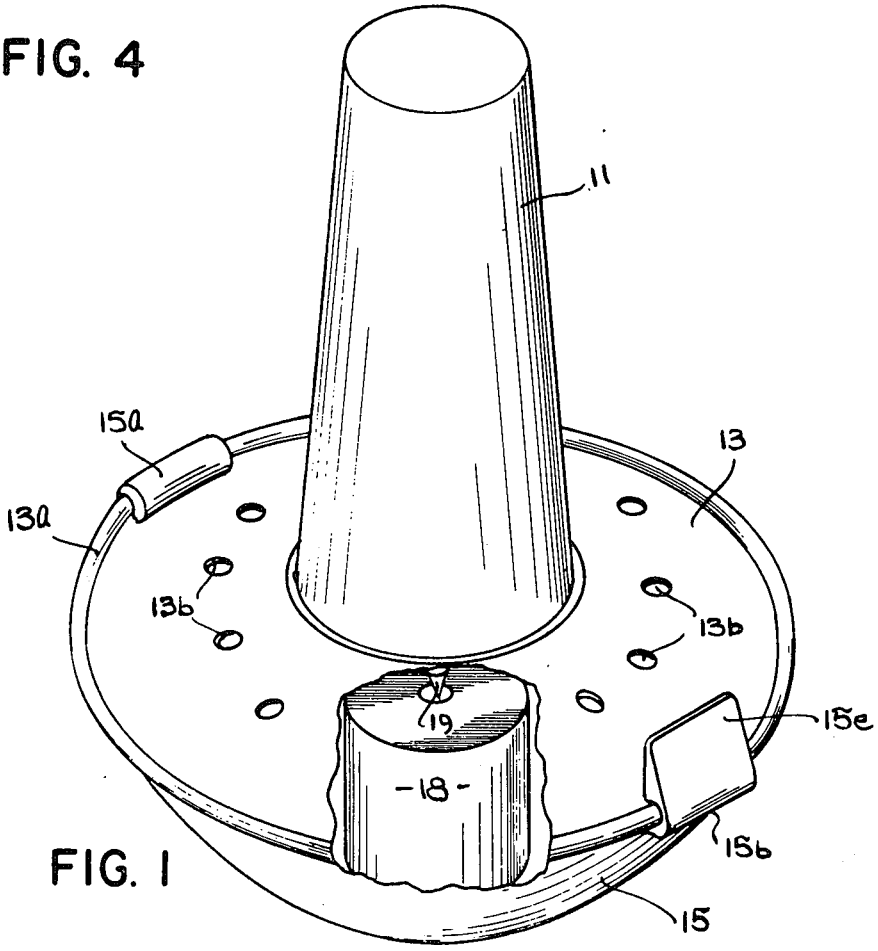
FIG. 1 is a perspective view of a preferred embodiment of the device of the invention.
Figure 2:
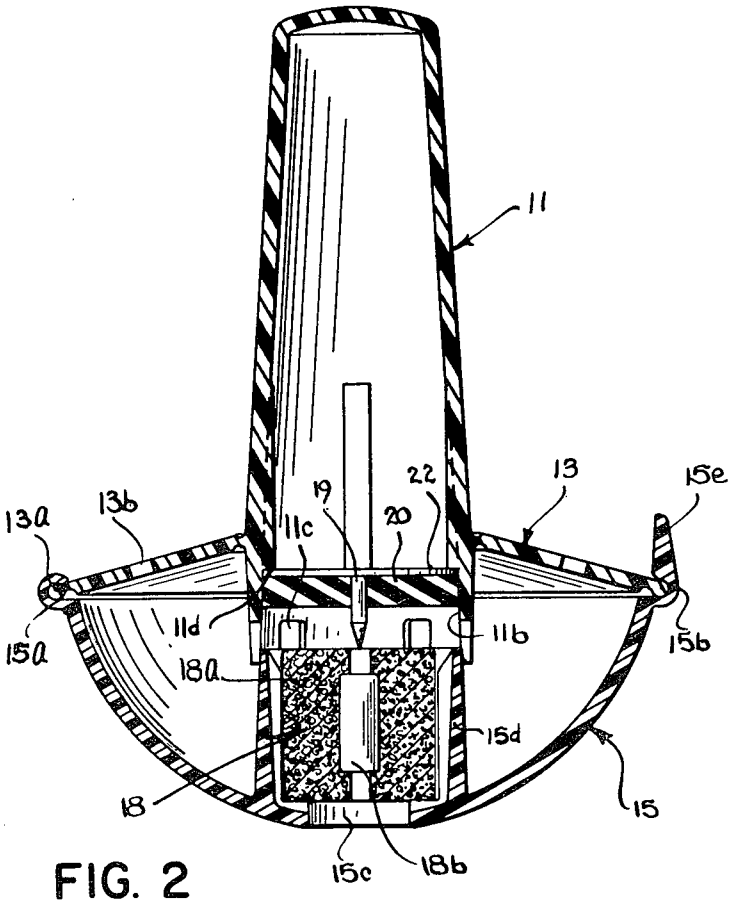
FIG. 2 is a cross-sectional view showing the preferred embodiment prior to its utilization.

Referring now to FIGS. 1 and 2, a preferred embodiment of a device which may be utilized to implement the invention is illustrated. Hand grip 11 is rigid and in the form of a frustrum of a cone and is fixedly attached to flexible over center snap diaphragm member 13. Diaphragm member 13 has a rim portion **13*a* which has a circular cross-section and fits into slots formed in retainer members 15*a* and 15*b* of seal member 15. Seal member 15 is fabricated of a material such as rubber or a suitable metal or plastic. Seal member 15 has a circular aperture 15*c* formed in the bottom portion thereof and a cylindrical holder member 15*d* into which cartridge 18 is placed. Tab member 15*e* is provided to enable the lifting of the diaphragm so that cartridge 18 can be placed in holder 15*d*. Thus when tab member 15*e* is pressed outwardly, diaphragm 13 may be drawn away from seal 15 on the hinge formed by member 15*a*. Alternatively, cartridge 18 may be installed through aperture 15*c***, the seal portions surrounding this aperture being elastic enough to permit the cartridge to pass through the aperture.

Figure 3:
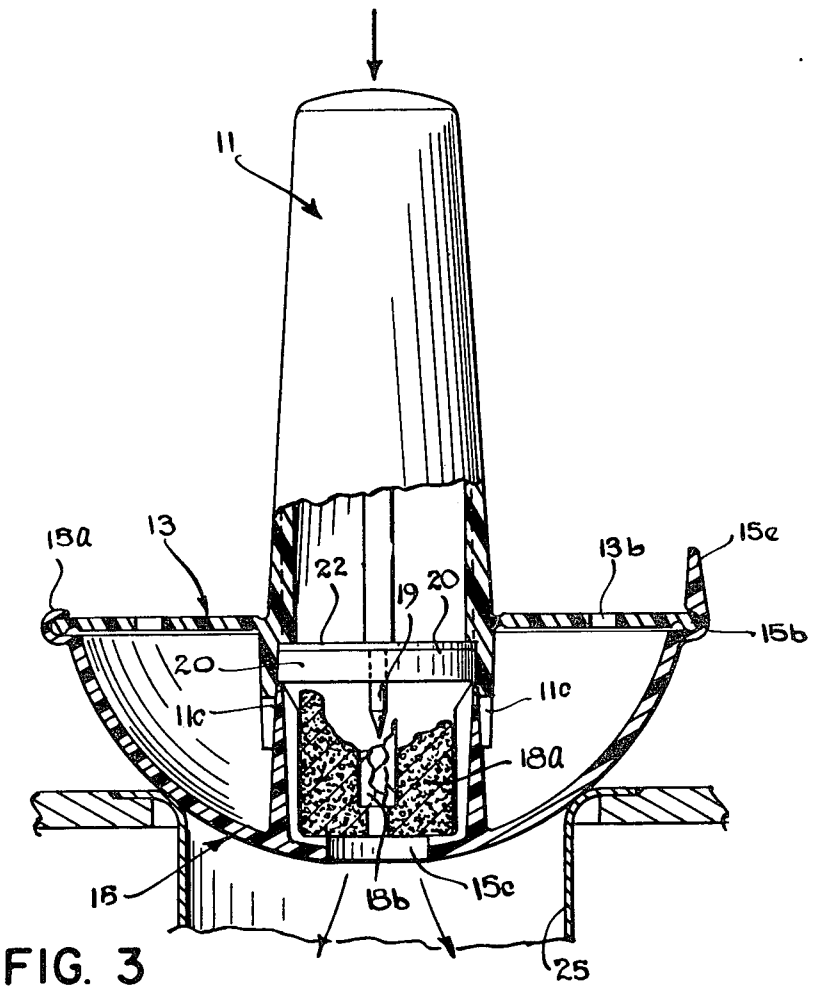
FIG. 3 is a cross-sectional view showing the preferred embodiment while being utilized to clear a clogged drain.

Mounted within grip 11 on circular plate 22 is trigger pin 19. Trigger pin 19 is fixedly attached to the plate 22, as for example by welding, the plate in turn being cemented to the side walls of grip 11. Sealing gasket 20 is cemented to plate 22 and the side walls of the grip. Grip 11 further has inner rib portions 11d which drive against plate 22 when the grip is actuated as shown in FIG. 3. Diaphragm 13 is fabricated of a resilient metal, plastic or rubber material which is biased to the position indicated in FIG. 2 Typically, the diaphragm will be biased so that about 20 pounds of downward force is required thereon to drive it from its rest position, this to assure that seal 15 is being sealed against the drain at this time. Apertures **13*b* are provided in the diaphragm to permit the inlet of water. Cartridge 18, for illustrative purposes, is shown as one having a dry material 18*a* and a liquid material contained within capsule 18*b*. The dry material 18*a* may comprise sodium peroxide, while the material within the capsule 18b** may comprise potassium permanganate dissolved in water.

The bottom edge portion **11*b* of grip 11 fits closely against the outer wall of cylindrical cartridge holder 15*d*, so as to minimize the passage of gas between these two members when the device is operated. Gasket 20 further operates to minimize the escape of gas. Apertures 11*c* are provided around the edge portion of the grip to permit the passage of water to the cartridge immediately prior to the actuation of the grip. These apertures are sealed against the wall of the cartridge holder when the grip is pushed downwardly as shown in FIG. 3**.

Referring now to FIG. 3, the operation of the device of the invention is illustrated. Seal member 15 is placed over the opening of drain 25, aperture **15*c* in the bottom portion of this seal providing fluid communication between the drain and cartridge 18. Grip 11 is then depressed downwardly against the bias of diaphragm 13 to cause seal 15 to seal tightly against the drain. This also causes trigger pin 19 to be driven downwardly, finally resulting in the piercing of capsule 18***b* by the trigger pin. It is to be noted that with downward motion of grip 11 as shown in FIG. 3, apertures 11*c* are sealed against the wall of cartridge holder 15*d*. When capsule 18*b* is pierced, the liquid potassium permanganate mixes with the sodium peroxide 18*a*, causing the generation of oxygen which is emitted in a blast through aperture 15*c* to effect unclogging of the drain. Diaphragm 13 preferably is made to have a snap action at the end of its travel, so that trigger pin 19 is driven sharply against the capsule.

A great variety of other materials may be utilized in implementing the invention, the basic requirements being that the mixture of such materials contained within the cartridge or the mixture of a cartridge material with water contained within the drain will cause a substantial emission of a harmless gas, i.e., one that is not harmful to either personnel or the plumbing fixtures. In the situation where the reaction is effected by mixture with the water over the drain opening, the use of trigger pin 19 can be dispensed with, the capsule in this instance having a water soluble outer skin whereby a short time after the capsule is exposed to water, the material will be released in the water and the desired reaction will occur. On the other hand, the water reactive material may be contained within a capsule which is non-water soluble and is released into the water by actuation of the trigger pin in the manner just described.

Typical examples of materials that can be used in cartridge 18 for reaction with water are as follows:

1. A mixture of sodium bisulfate (3 parts by weight), potassium bicarbonate (2 parts by weight), a powdered sudsing agent (1 part by weight). Mixture with water results in the generation of carbon dioxide.

2. A mixture of 1 part ammonium chloride, 2 parts aluminum powder and 4 parts ammonium nitrate. Mixture with water results in the emission of Nitrogen and Hydrogen gas.

3. A mixture of 2 parts bicarbonate of soda and 1 part citric acid granules which when exposed to water will result in the emission of carbon dioxide.

Figure 4:
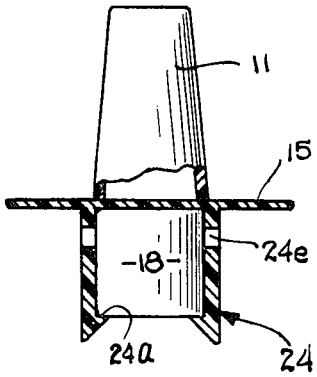
FIG. 4 is a cross-sectional view of a second embodiment of the invention.

Referring now to FIG. 4, a second embodiment of the invention is illustrated. In this second embodiment, seal 15 is in the form of a flat resilient disk which has a resilient cylindrical cartridge holder 24 extending therefrom. Cartridge 18 is snapped into the holder through the bottom opening therein and retained against the lip portion 24*a* thereof. Apertures 24*b* are provided in the wall of the holder to permit the free flow of water to the cartridge. The cartridge material for this embodiment must be one which will react with water to generate the gas and which is retained within a water soluble container. Thus, when seal 15 is pressed against the drain opening, water in the drain will react with the cartridge to generate the gas for clearing the drain.

Figure 5:
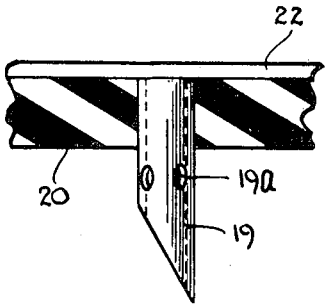
FIG. 5 is an elevational view of a alternative type of trigger pin for use in the preferred embodiment.

Referring now to FIG. 5, an alternative type of trigger pin for use in the preferred embodiment is illustrated. In this instance, trigger pin 19 is hollow and has apertures 19a formed therein for admitting water. Thus, when the device is placed in a water filled sink or the like, the pin will fill with water so that when the pin is driven into the capsule, it will operate to inject water into the center of the cartridge material. This makes for a more effective outward driving force.

While the invention has been described and illustrated in detail, it is to be clearly understood that this is intended by way of illustration and example only, and is not to be taken by way of limitation, the spirit and scope of the invention being limited only by the terms of the following claims.

I claim:

1. A device for use in unclogging a drain comprising:
means for forming a seal around the drain opening,
cartridge means having at least two materials retained thereby capable of effecting a reaction with each other to cause the immediate emission of gas at a substantial pressure,
means for retaining said cartridge means in fluid communication with said drain and within said seal, and
means for mixing said materials in said cartridge means with each other to effect said reaction whereby gas is immediately released into the drain at a substantial pressure to free the clogging substance therefrom.

2. The device of claim 1 wherein the first of said materials is contained within a sealed container, said mixing means comprising means for piercing the container to effect the mixing.

3. The device of claim 2 wherein the second of said materials is a liquid.

4. The device of claim 3 wherein said materials comprise dry sodium peroxide and potassium permanganate solution.

5. The device of claim 2 wherein the means for piercing the cartridge means comprises a trigger pin, said device including a hand grip for use in driving said trigger pin against said cartridge and for holding said seal means against the drain opening in sealing relationship therewith, and a diaphragm for biasing the grip and trigger pin away from the cartridge.

6. The device of claim 1 wherein said means for retaining said cartridge means comprises a holder member having a wall which extends from said seal forming means to form a receptacle for holding said cartridge means.

7. The device of claim 6 wherein the means for forming a seal comprises a seal member having an aperture formed therein, said holder member wall running around said aperture and grip means for use in pressing said seal member over the drain with said aperture opposite the drain opening, said grip means slidably fitting over the holder member to form a seal therebetween when the grip means is actuated to press the seal member over the drain.

8. A device for use in unclogging a drain having water thereabove, comprising:
means for forming a seal around the drain opening,
cartridge means having at least one material retained thereby capable of effecting a reaction with water to cause the immediate emission of gas at a substantial pressure,
means for retaining said cartridge in fluid communication with said drain and within said seal, and
means for mixing the material retained by said cartridge means with the water above the drain to effect said reaction whereby gas is immediately released into the drain at a substantial pressure to free the clogging substance therefrom.

9. The device of claim 8 wherein said means for mixing the material retained by said cartridge means with the water comprises a water soluble container for containing said material, said container being dissolved by the water thereby permitting the material and water to mix to effect the reaction.

10. The device of claim 8 wherein the material retained by the cartridge means is contained within a sealed container, said means for mixing said material with the water comprising means for puncturing the container.

11. The device of claim 10 wherein the puncturing means comprises a trigger pin, said device including a hand grip for use in driving the trigger pin against said cartridge and for holding said seal means against the drain opening in sealing relationship therewith, and a diaphragm for biasing the grip and trigger pin away from the cartridge.

12. The device of claim 11 wherein said trigger pin is hollow and is adapted to receive water therein from above the drain opening, whereby said pin operates to inject water into said cartridge on the piercing of said sealed container.

13. The device of claim 8 wherein said means for retaining said cartridge comprises a holder member having a wall which extends away from said seal forming means to form a receptacle for holding said cartridge.

14. The device of claim 13 wherein the means for forming a seal comprises a seal member having an aperture formed therein, said holder member wall running around said aperture and grip means for use in pressing said seal member over the drain with the aperture opposite the drain opening, said grip means slidably fitting over the holder member to form a seal therebetween when the grip means is actuated to press the seal member over the drain member.

* * * * *